US012780497B2

(12) United States Patent
Mitsuo et al.

(10) Patent No.: US 12,780,497 B2
(45) Date of Patent: Nov. 3, 2026

(54) COLLAPSIBLE CONTAINER

(71) Applicant: KYOCERA Document Solutions Inc., Osaka (JP)

(72) Inventors: Yoshiaki Mitsuo, Osaka (JP); Hiroshi Wada, Osaka (JP); Hidehisa Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 52 days.

(21) Appl. No.: 18/718,587

(22) PCT Filed: Dec. 8, 2022

(86) PCT No.: PCT/JP2022/045288
§ 371 (c)(1),
(2) Date: Jun. 11, 2024

(87) PCT Pub. No.: WO2023/112824
PCT Pub. Date: Jun. 22, 2023

(65) Prior Publication Data

US 2025/0042611 A1 Feb. 6, 2025

(30) Foreign Application Priority Data

Dec. 16, 2021 (JP) ..... 2021-204413

(51) Int. Cl.
*B65D 21/08* (2006.01)

(52) U.S. Cl.
CPC ..... *B65D 21/086* (2013.01)

(58) Field of Classification Search
CPC .. B65D 21/086; B65D 11/182; B65D 11/1186
See application file for complete search history.

(56) References Cited

U.S. PATENT DOCUMENTS 3,768,416 A * 10/1973 Juechter ..... B65D 19/38 104/135
3,796,342 A * 3/1974 Sanders ..... B65D 11/1826 220/6

(Continued)

FOREIGN PATENT DOCUMENTS

JP S 52-34730 U 8/1975
JP H 04-501097 A 2/1992

(Continued)

OTHER PUBLICATIONS

International Search Report dated Feb. 21, 2023, issued by the Japanese Patent Office in corresponding application PCT/JP2022/045288.

*Primary Examiner* — Anthony D Stashick
*Assistant Examiner* — Blaine G Neway
(74) *Attorney, Agent, or Firm* — Stein IP, LLC

(57) ABSTRACT

A collapsible container includes a lower frame, an upper frame, a pair of flip-up lateral plates, a pair of divided lateral plates, and a pair of lid plates. Each of the pair of divided lateral plates includes an upper lateral plate, a lower lateral plate, and a hinge. On outer lateral surfaces of the upper lateral plate and the lower lateral plate, a plurality of upper reinforcement ribs and a plurality of lower reinforcement ribs are formed, respectively, astride the hinge. Convexities are formed on one of the upper reinforcement ribs and the lower reinforcement ribs. When the divided lateral plates are in a bent state, the upper reinforcement ribs are opposed to upper parts of the lower reinforcement ribs, and the convexities contact the other of the upper reinforcement ribs and the lower reinforcement ribs.

4 Claims, 12 Drawing Sheets

(56) References Cited

U.S. PATENT DOCUMENTS

| | | | | |
|---|---|---|---|---|
| 5,190,179 | A * | 3/1993 | Richter | B65D 90/008 220/6 |
| 6,616,003 | B1 * | 9/2003 | Polenta | B65D 1/44 220/6 |
| 6,868,979 | B2 * | 3/2005 | Rader | B65D 11/184 220/4.28 |
| 7,325,697 | B2 * | 2/2008 | Lim | A47B 55/02 211/187 |
| 2011/0062167 | A1 | 3/2011 | Colton et al. | 220/666 |

FOREIGN PATENT DOCUMENTS

| | | | | |
|---|---|---|---|---|
| JP | H 06-78228 | U | 11/1994 | |
| JP | H 09-240665 | A | 9/1997 | |
| JP | 2004-161303 | A | 6/2004 | |
| JP | 2006-182422 | A | 7/2006 | |
| JP | 2008-013193 | A | 1/2008 | |
| JP | 3202726 | U | 1/2016 | |
| JP | 2017-218212 | A | 12/2017 | |
| TW | 201412615 | A * | 4/2014 | B65D 11/1826 |

* cited by examiner

COLLAPSIBLE CONTAINER

CROSS-REFERENCE TO RELATED APPLICATIONS

This application is a national stage of International Application No. PCT/JP2022/045288, filed Dec. 8, 2022, which claims the benefit of Japanese Application No. 2021-204413, filed Dec. 16, 2021, in the Japanese Patent Office, the disclosures of which are incorporated herein by reference.

TECHNICAL FIELD

The present invention relates to a collapsible container that can be collapsed and is used for safekeeping, transportation, and so on of various articles.

BACKGROUND ART

There is conventionally known a collapsible container that is a container used for storage, conveyance, and so on of articles and is structured to be storable in a state of being collapsed so that lateral plates thereof are overlaid on a bottom plate thereof and to be assembled in use by raising the lateral plates with respect to the bottom plate.

For example, Patent Document 1 discloses a collapsible container including an upper frame, a bottom, flip-up lateral walls, divided lateral walls, and a pair of lid plates. The flip-up lateral walls are each hingedly connected at an upper end to the upper frame. The divided lateral walls are each composed of an upper divided lateral wall situated above a hinge and a lower divided lateral wall situated below the hinge. The upper divided lateral wall and the lower divided lateral wall are obtained by division so as to be pivotable toward inside the collapsible container, and the upper divided lateral wall is hingedly connected at an upper end to the upper frame, while the lower divided lateral wall is hingedly connected at a lower end to the bottom. The pair of lid plates is hingedly connected to opposed long sides of the upper frame.

Furthermore, Patent Document 2 discloses a collapsible container structured to have an upper plate member and a lower plate member connected to each other so as to be relatively rotatable approximately 180 degrees and configured as follows. That is, on an outer lateral surface of one of the plate members, an axial support portion is provided to protrude at a location somewhat inward from an end edge of the one of the plate members near a joint between them, a cantilevered support shaft is formed integrally with the axial support portion, a part of the other of the plate members having a given width from an end edge of the other of the plate members near the joint is bent outwardly so as to be stepped at least to an extent corresponding to a thickness of the one of the plate members opposed thereto, a pair of outward bulges is formed at the end edge of the other of the plate members near the joint so that the outward bulges are spaced at such a distance from each other as to allow the axial support portion to be situated therebetween, and one of the outward bulges includes a bearing in a shape of a tubular cutout into which the cantilevered support shaft is to be loosely fitted.

CITATION LIST

Patent Literature

Patent Document 1: Japanese Unexamined Patent Application Publication No. 2004-161303

Patent Document 2: Japanese Unexamined Patent Application Publication No. 2006-182422

SUMMARY OF INVENTION

Technical Problem

When a load (a pressing force) in an up-down direction is applied to a collapsible container as described above in a collapsed state as in a case where a large number of collapsible containers are stacked on each other, there has been a possibility that a hinge connecting between an upper lateral plate and a lower lateral plate constituting a divided lateral plate is brought into pressure contact to be deformed or broken.

In view of the above-described problem, it is an object of the present invention to provide a collapsible container capable of reducing a load applied to a hinge connecting an upper lateral plate to a lower lateral plate in a collapsed state.

Solution to Problem

In order to achieve the above-described object, a first configuration of the present invention relates to a collapsible container including a lower frame, an upper frame, a pair of flip-up lateral plates, a pair of divided lateral plates, and a pair of lid plates. The lower frame includes a rectangular bottom plate. The upper frame has a frame shape substantially identical to that of an outer rim of the lower frame and includes a pair of first lateral surfaces opposed to each other and a pair of second lateral surfaces each connecting an end of one of the pair of first lateral surfaces to an end of the other of the pair of first lateral surfaces. Each of the pair of flip-up lateral plates is swingably supported at an upper end to the upper frame and is configured to swing between an upright state of being perpendicularly upright with respect to the bottom plate along a corresponding one of the pair of first lateral surfaces and a laid-down state of being laid down to be overlaid on the bottom plate. Each of the pair of divided lateral plates includes an upper lateral plate swingably supported to a corresponding one of the pair of second lateral surfaces, a lower lateral plate swingably supported to the bottom plate, and a hinge pivotably connecting a lower end of the upper lateral plate to an upper end of the lower lateral plate, and is configured to shift between a spread state where the upper lateral plate and the lower lateral plate are spread to be substantially flush with each other and a bent state where the upper lateral plate and the lower lateral plate are bent inwardly. Each of the pair of lid plates is pivotably supported to an upper part of a corresponding one of the pair of second lateral surfaces and thus enables opening and closing of an opening of the upper frame. The collapsible container is collapsible to flat form when the pair of flip-up lateral plates is brought to the laid-down state and the pair of divided lateral plates is brought to the bent state. On outer lateral surfaces of the upper lateral plate and the lower lateral plate, a plurality of first reinforcement ribs is linearly and continuously formed to extend in an up-down direction from an upper end to a lower end of each of the pair of divided lateral plates astride the hinge. Each of the plurality of first reinforcement ribs includes an upper reinforcement rib formed on the upper lateral plate and a lower reinforcement rib formed on the lower lateral plate, and a convexity is formed in one of the upper reinforcement rib and the lower reinforcement rib. When the pair of divided lateral plates is in the bent state, the upper reinforcement rib is opposed to an upper part of the lower reinforcement rib, and the convexity contacts the other of the upper reinforcement rib and the lower reinforcement rib.

Advantageous Effects of Invention

According to the first configuration of the present invention, the convexity formed in one of the upper reinforcement rib formed on the upper lateral plate and the lower reinforcement rib formed on the lower lateral plate contacts the other of the upper reinforcement rib and the lower reinforcement rib, and thus there can be achieved a balance of a pressing force acting on the lower lateral plate and the upper lateral plate in a collapsed state. It is, therefore, possible to reduce a load applied to the hinge, thus effectively suppressing deformation or breakage of the upper lateral plate, the lower lateral plate, and the hinge.

DESCRIPTION OF EMBODIMENTS

Figure 1:
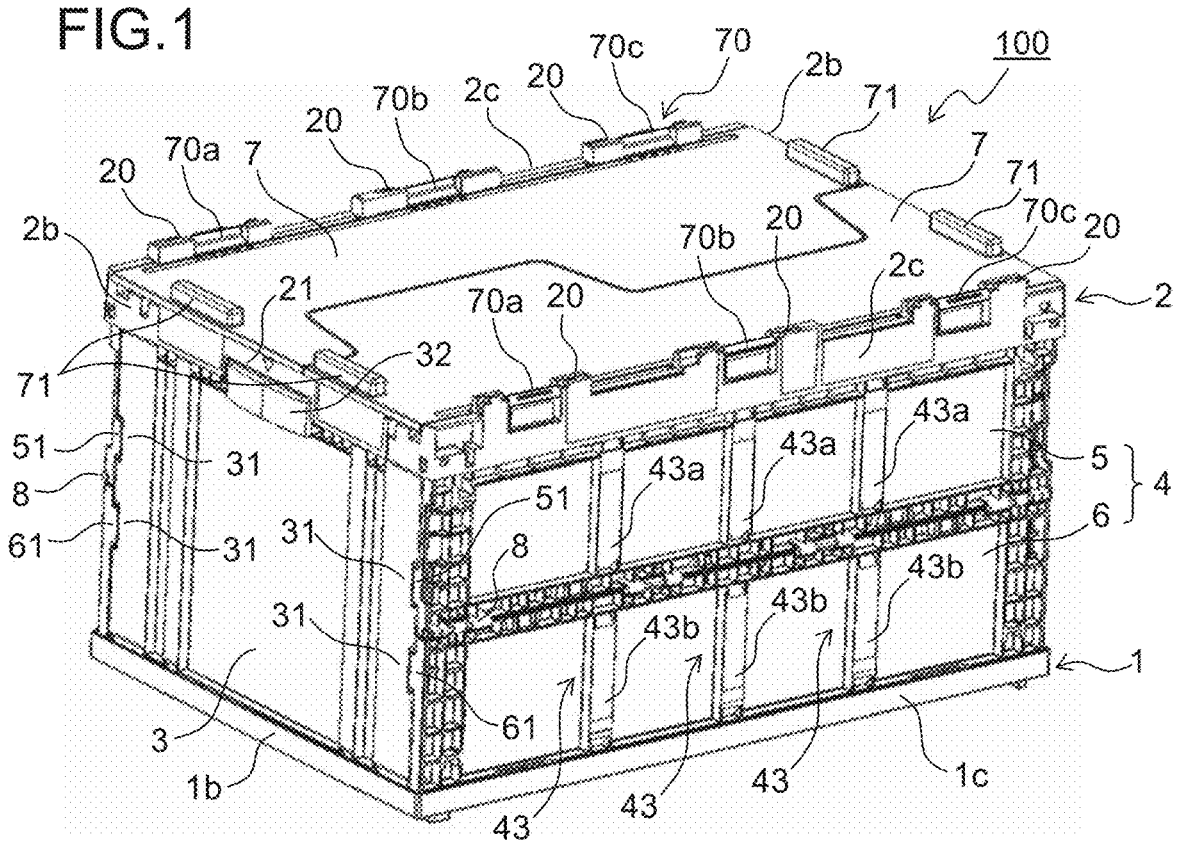
FIG. 1 A perspective view showing an assembled state of a collapsible container 100 according to an embodiment of the present invention.
Figure 2:
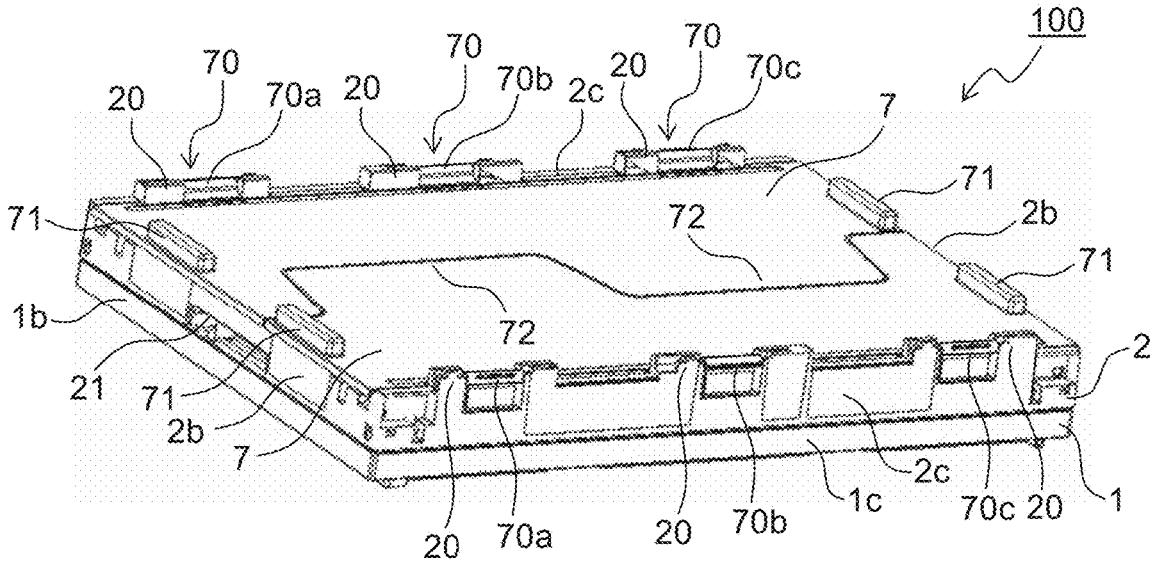
FIG. 2 A perspective view showing a collapsed state of the collapsible container 100 of the present embodiment.

The following describes an embodiment of the present invention with reference to the appended drawings. FIG. 1 is a perspective view showing an assembled state of a collapsible container 100 according to the embodiment of the present invention. FIG. 2 is a perspective view showing a collapsed state of the collapsible container 100 of the present embodiment. The collapsible container 100 is made of synthetic resin and includes a lower frame 1, an upper frame 2, flip-up lateral plates 3, divided lateral plates 4, and lid plates 7. The lower frame 1, the flip-up lateral plates 3, the divided lateral plates 4, and the lid plates 7 are colored in black, and the upper frame 2 is colored in white.

The lower frame 1 includes a rectangular bottom plate 1*a* (see FIG. 3), first upright walls 1*b* that are perpendicularly upright along short sides of the bottom plate 1*a*, and second upright walls 1*c* that are perpendicularly upright along long sides of the bottom plate 1*a*. The upper frame 2 is a frame having a rectangular shape as viewed in plan, which is a shape substantially identical to that of an outer rim of the lower frame 1, and includes a pair of first lateral surfaces 2*b* opposed to each other and a pair of second lateral surfaces 2*c* each connecting an end of one of the pair of first lateral surfaces 2*b* to an end of the other of the pair of first lateral surfaces 2*b*. The first lateral surfaces 2*b* form short sides of the upper frame 2, and the second lateral surfaces 2*c* form long sides of the upper frame 2.

Between the first upright walls 1*b* of the lower frame 1 and the first lateral surfaces 2*b* of the upper frame 2, a pair of flip-up lateral plates 3 is disposed oppositely to each other. Each of the flip-up lateral plates 3 is pivotably connected at an upper end to an inner side of a corresponding one of the first lateral surfaces 2*b* of the upper frame 2. The flip-up lateral plates 3 are pivotable between an upright state of being perpendicularly upright with respect to the lower frame 1 and a laid-down state of being laid down inwardly to be overlaid on the lower frame 1.

Between the second upright walls 1*c* of the lower frame 1 and the second lateral surfaces 2*c* of the upper frame 2, a pair of divided lateral plates 4 is disposed oppositely to each other. Each of the divided lateral plates 4 includes an upper lateral plate 5, a lower lateral plate 6, and a hinge 8. The upper lateral plate 5 is pivotably connected at an upper end to an inner side of a corresponding one of the second lateral surfaces 2*c* of the upper frame 2. The lower lateral plate 6 is pivotably connected at a lower end to bearings 10 (see FIG. 13) formed on the bottom plate 1*a* of the lower frame 1. The hinge 8 connects, at plural locations thereon, a lower end of the upper lateral plate 5 to an upper end of the lower lateral plate 6. With this configuration, the divided lateral plates 4 are shiftable between a spread state where the upper lateral plate 5 and the lower lateral plate 6 are spread to be substantially flush with each other and a bent state where the upper lateral plate 5 and the lower lateral plate 6 are bent inwardly to be overlaid on the lower frame 1.

On an outer lateral surface of each of the divided lateral plates 4, a plurality of (herein, three rows of) first reinforcement ribs 43 is formed to extend in an up-down direction. Each of the first reinforcement ribs 43 includes an upper reinforcement rib 43*a* formed between the upper end of the upper lateral plate 5 and the hinge 8 and a lower reinforcement rib 43*b* formed between the lower end of the lower lateral plate 6 and the hinge 8. The upper reinforcement rib 43*a* and the lower reinforcement rib 43*b* are linearly formed to be continuous from an upper end to a lower end of each of the divided lateral plates 4 astride the hinge 8.

A pair of lid plates 7 is mounted to the second lateral surfaces 2*c* of the upper frame 2 so as to be pivotable up and down. To be more specific, three connection arms 70 are formed on a proximal end of each of the lid plates 7 (a joint between the each of the lid plates 7 and the upper frame 2). The connection arms 70 include bearings 70*a* to 70*c*, respectively. On an upper part of each of the second lateral surfaces 2*c* of the upper frame 2, three lid plate support portions 20 pivotably supporting the bearings 70*a* to 70*c* are formed, i.e., six lid plate support portions 20 in total are formed on the second lateral surfaces 2*c*. On each of the lid plates 7, two positioning protrusions 71 each having a rectangular parallelepiped shape are formed at positions where the each of the lid plates 7 overlaps the first lateral surfaces 2*b* of the upper frame 2, i.e., four positioning protrusions 71 in total are formed on the lid plates 7. A first grip portion 21 that is a rectangular cutout is formed in each of the first lateral surfaces 2*b* of the upper frame 2.

At a distal end (a pivotal end) of each of the lid plates 7, there are formed a flap 72 extending toward an opposed one of the lid plates 7 and a receiver 73 (see FIG. 3) to be overlapped by the flap 72. The pair of lid plates 7 is caused to pivot upward with respect to the upper frame 2, and thus an opening 2*a* of the upper frame 2 disposed on an upper surface of the collapsible container 100 can be opened. Moreover, the distal ends (the pivotal ends) of the lid plates 7 are alternately mated with each other so that the flap 72 of one of the lid plates 7 overlaps the receiver 73 of the other of the lid plates 7, and thus the opening 2*a* can be closed.

In the collapsible container 100 configured as above, the upper lateral plate 5 and the lower lateral plate 6 of each of the pair of divided lateral plates 4 are spread, and the flip-up lateral plates 3 are raised substantially perpendicularly. Thus, the collapsible container 100 can be assembled in box form as shown in FIG. 1. At this time, lower ends of the flip-up lateral plates 3 are brought into engagement with engagement convexities 12 (see FIG. 13) formed on the bottom plate 1*a* of the lower frame 1, and upper engagement pieces 51 of the upper lateral plate 5 and lower engagement pieces 61 of the lower lateral plate 6 are brought into engagement with engagement holes 31 of the flip-up lateral plates 3. Thus, an upright state of the flip-up lateral plates 3 and a spread state of the divided lateral plates 4 are retained.

Furthermore, the lower ends of the flip-up lateral plates 3 are disengaged from the engagement convexities 12, and the upper engagement pieces 51 and the lower engagement pieces 61 are disengaged from the engagement holes 31, so that the divided lateral plates 4 (the upper lateral plate 5 and the lower lateral plate 6) are bent to be collapsed inwardly (referred to as a bent state). Further, the flip-up lateral plates 3 are caused to pivot upward to be horizontal (referred to as a laid-down state). Thus, the divided lateral plates 4 and the flip-up lateral plates 3 are tucked in a state of being overlaid on each other between the upper frame 2 and the lower frame 1, and thus the collapsible container 100 can be collapsed flat as shown in FIG. 2. Furthermore, the first grip portion 21 of the upper frame 2 is gripped and lifted from the state shown in FIG. 2, and thus the collapsible container 100 can be assembled back in box form.

Figure 3:
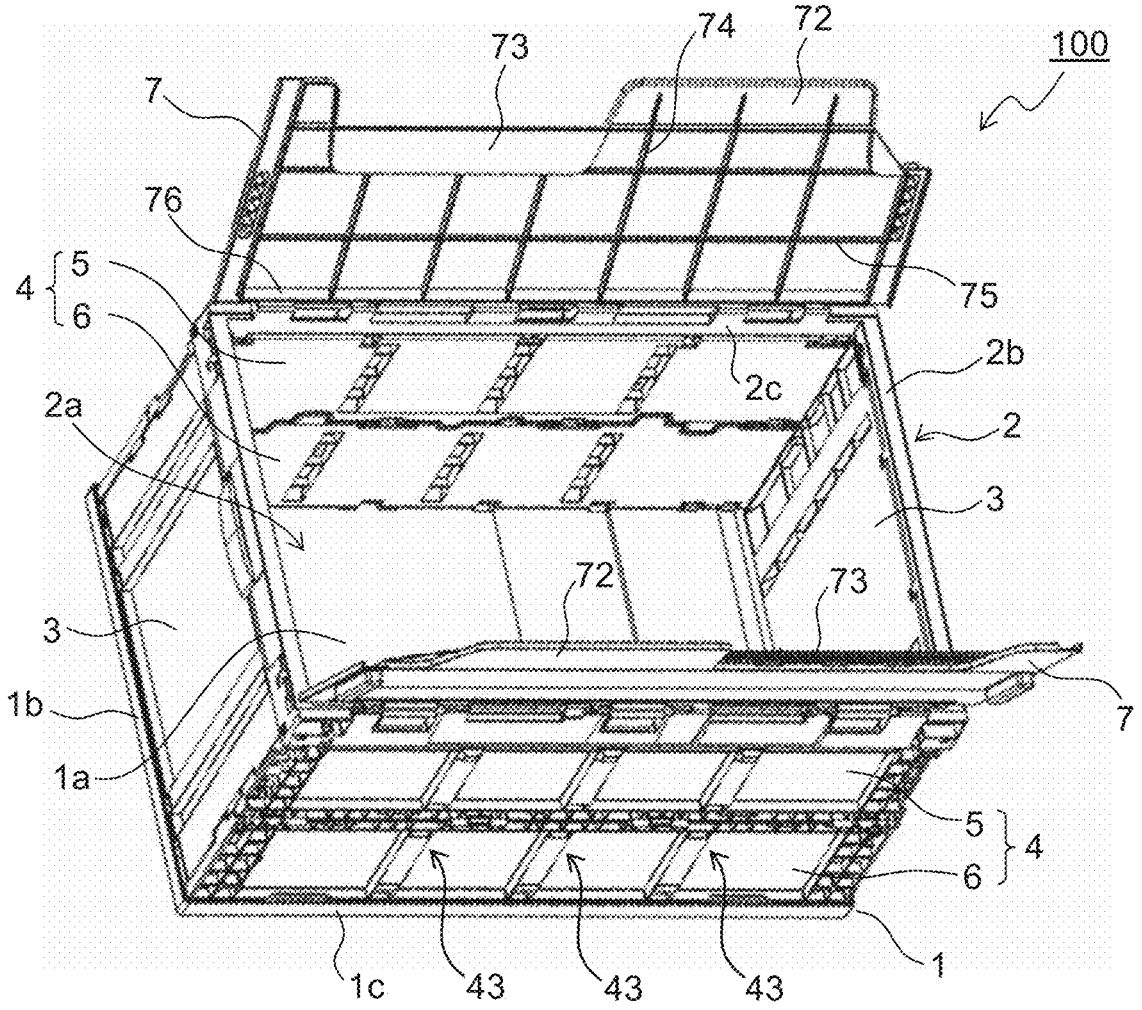
FIG. 3 A perspective view, as viewed from above, of a state where lid plates 7 of the collapsible container 100 are retained at a prescribed opening angle.
Figure 4:
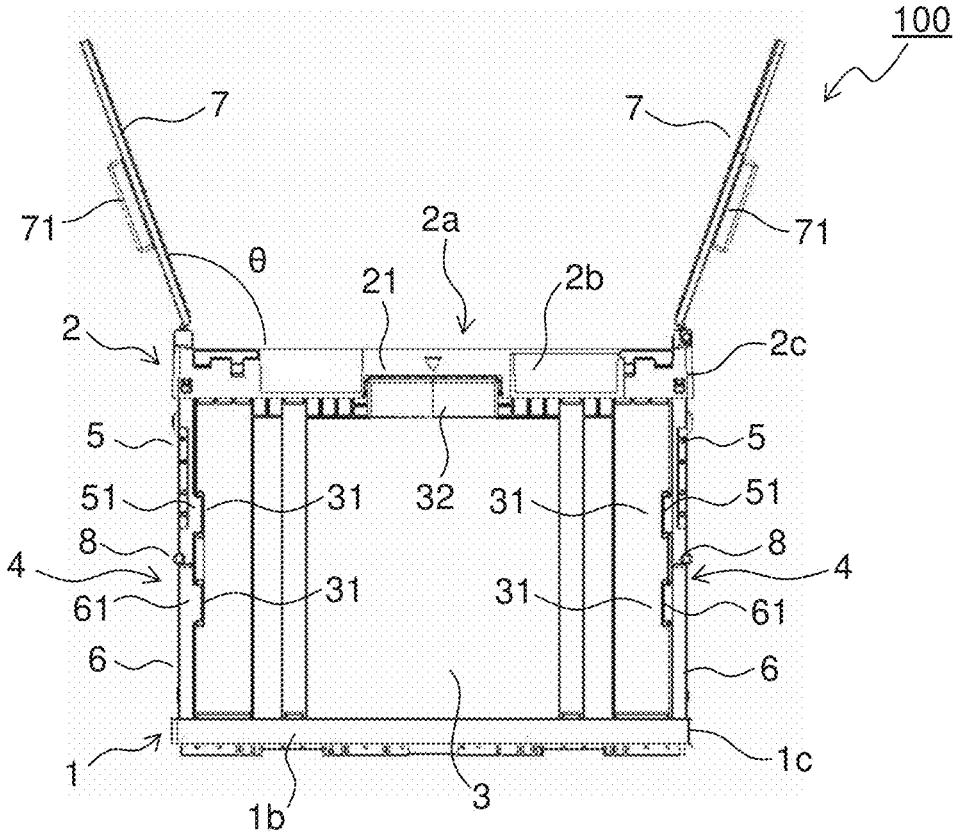
FIG. 4 A lateral view, as viewed from near a lift-up lateral plate 3, of the state where the lid plates 7 of the collapsible container 100 are retained at the prescribed opening angle.

FIG. 3 is a perspective view, as viewed from above, of a state where the lid plates 7 of the collapsible container 100 are retained at a prescribed opening angle. FIG. 4 is a lateral view, as viewed from near one of the lift-up lateral plates 3, of a state where the lid plates 7 of the collapsible container 100 are retained at the prescribed opening angle. As shown in FIG. 3, on a rear surface of each of the lid plates 7, a plurality of first ribs 74 parallel to the first lateral surfaces 2*b* of the upper frame 2 and a plurality of second ribs 75 parallel to the second lateral surfaces 2*c* of the upper frame 2 are formed in lattice form. The first ribs 74 and the second ribs 75 function to increase bending strength of the lid plates 7 and to suppress occurrence of warpage in molding.

An inclined surface 76 is formed at a rear edge of each of the lid plates 7 (in a neighborhood of the connection arms 70) opposed to a corresponding one of the second lateral surfaces 2*c*. In a state where the lid plates 7 are retained at the opening angle, the inclined surface 76 is inclined downward toward the opening 2*a*. The inclined surface 76 is formed over substantially an entire region of each of the lid plates 7 in a longitudinal direction thereof (a left-right direction in FIG. 3) along a corresponding one of the second lateral surfaces 2*c*.

Figure 5:
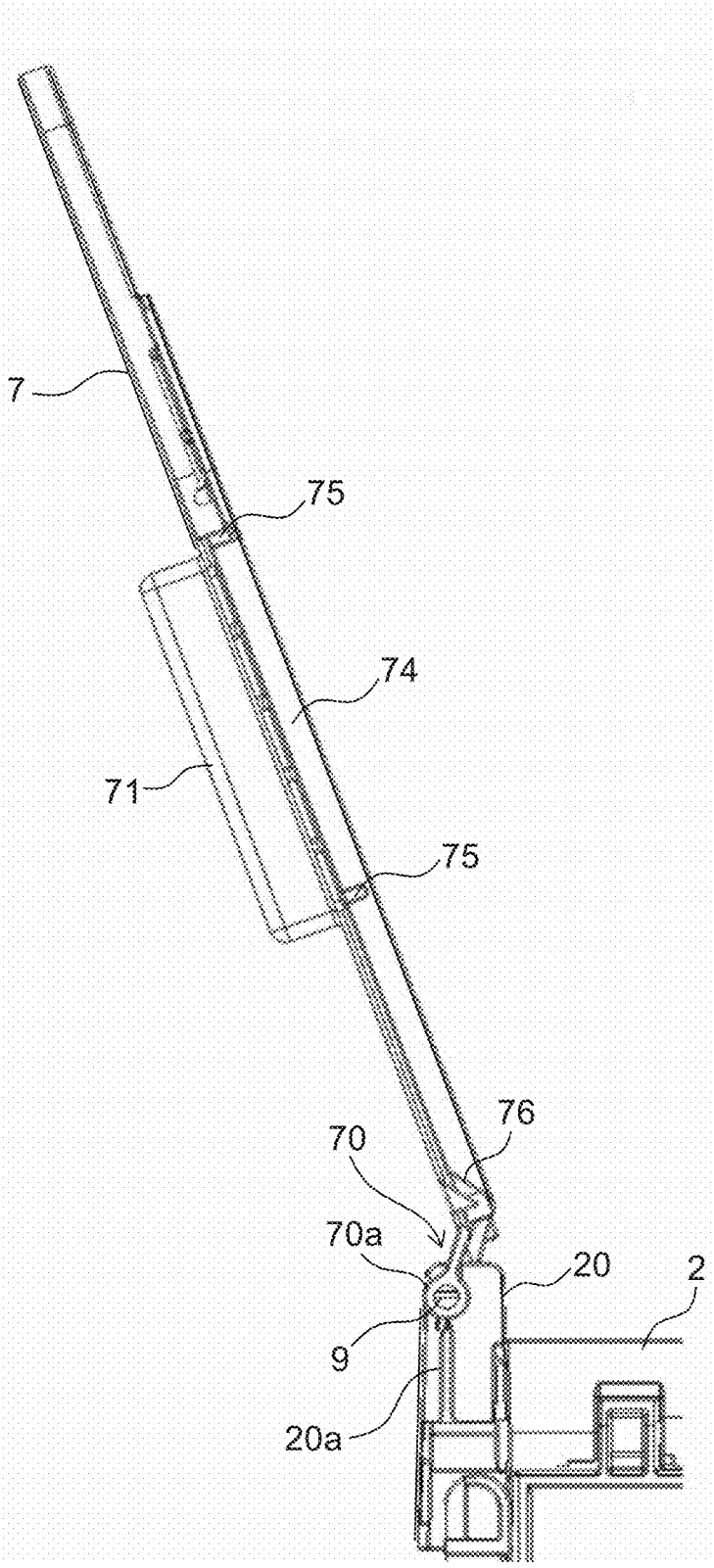
FIG. 5 A sectional view including a bearing 70*a* of a left one of the lid plates 7 shown in FIG. 4.

FIG. 5 is a sectional view including the bearing 70*a* of a left one of the lid plates 7 shown in FIG. 4. Each of the bearings 70*a* to 70*c* has a shape of a hollow cylinder and includes a resinous connection pin (connection shaft) 9 slidably inserted therein. The connection pin 9 is supported at both ends to each of the lid plate support portions 20. With the above-described configuration, the lid plates 7 are pivotably supported to the upper parts of the second lateral surfaces 2*c* of the upper frame 2.

Figure 6:
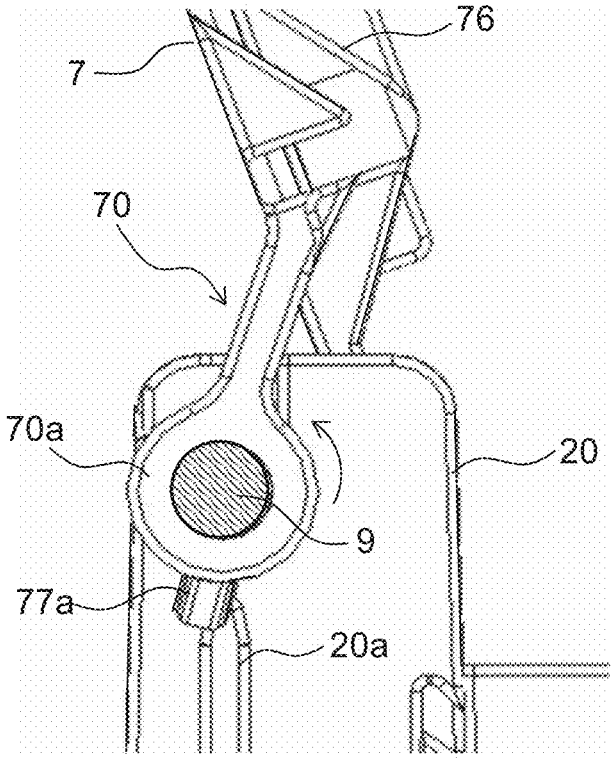
FIG. 6 An enlarged view of a joint between a lid plate support portion 20 and the bearing 70*a*, illustrating a state where a first engagement protrusion 77*a* formed on the bearing 70*a* is engaged externally with an angle restrictor 20*a* formed in the lid plate support portion 20.
Figure 7:
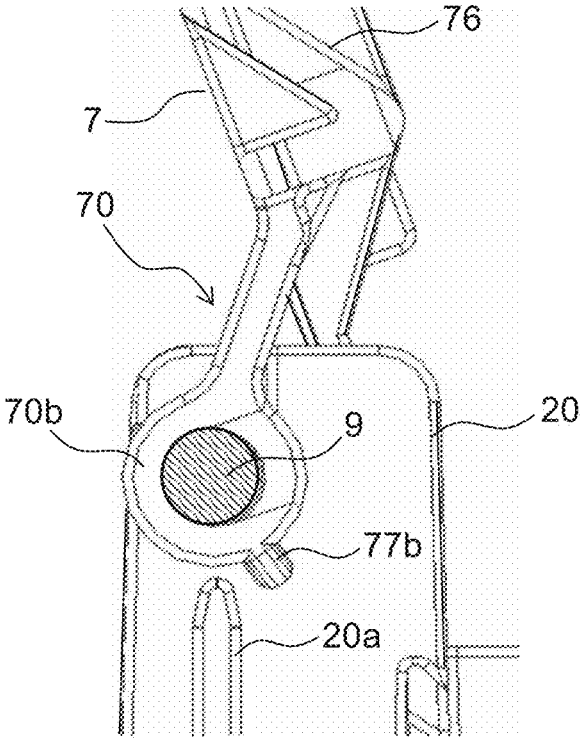
FIG. 7 An enlarged view of a joint between the lid plate support portion 20 and a bearing 70*b*, illustrating a state where a second engagement protrusion 77*b* formed on the bearing 70*b* is engaged internally with the angle restrictor 20*a* formed in the lid plate support portion 20.

FIG. 6 and FIG. 7 are enlarged views of a joint between one of the lid plate support portions 20 and the bearing 70*a* and a joint between another one of the lid plate support portions 20 and the bearing 70*b*, respectively. The bearing 70*c* is configured similarly to the bearing 70*a* shown in FIG. 6, and a duplicate description thereof, therefore, is omitted. Furthermore, a right one of the lid plates 7 shown in FIG. 4 is also configured similarly, expect for being symmetrical, to a configuration shown in FIG. 6 and FIG. 7.

As shown in FIG. 6, a first engagement protrusion 77*a* is formed on an outer circumferential surface of each of the bearings 70*a* and 70*c*. As shown in FIG. 7, a second engagement protrusion 77*b* is formed on an outer circumferential surface of the bearing 70*b*. The first engagement protrusion 77*a* of each of the bearings 70*a* and 70*c* is different in position in a circumferential direction (phase) from the second engagement protrusion 77*b* of the bearing 70*b*. To be more specific, the first engagement protrusion 77*a* is formed upstream relative to the second engagement protrusion 77*b* in a pivotal direction of the bearings 70*a* to 70*c* for opening the lid plates 7 (a counterclockwise direction in FIG. 6 and FIG. 7).

Furthermore, in each of the lid plate support portions 20, an angle restrictor 20*a* is formed at a position opposed to a corresponding one of the bearings 70*a* to 70*c*. A distance between the outer circumferential surface of each of the bearings 70*a* to 70*c* and the angle restrictor 20*a* is smaller than a protruding amount of each of the first engagement protrusion 77*a* and the second engagement protrusion 77*b*. Therefore, when the bearings 70*a* to 70*c* pivot, each of the first engagement protrusion 77*a* and the second engagement protrusion 77*c* contacts the angle restrictor 20*a*.

As the pair of lid plates 7 is caused to pivot upward from the state shown in FIG. 1 where the opening 2*a* of the upper frame 2 is closed by the lid plates 7, first, the second engagement protrusion 77*b* of the bearing 70*b* contacts an outer lateral surface (a left lateral surface in FIG. 7) of the angle restrictor 20*a*. When the lid plates 7 are caused to pivot further, as shown in FIG. 7, the second engagement protrusion 77*b* rides over the angle restrictor 20*a* and moves to an inner side of the angle restrictor 20*a* (to the right in FIG. 7).

At this time, as shown in FIG. 6, the first engagement protrusion 77*a* of each of the bearings 70*a* and 70*c* contacts the outer lateral surface (the left lateral surface in FIG. 6) of the angle restrictor 20*a*. That is, as viewed from an axis direction of the connection pin 9, the first engagement protrusion 77*a* and the second engagement protrusion 77*b* are disposed so as to interpose the angle restrictor 20*a* therebetween. This configuration restricts pivoting of the first engagement protrusion 77*a* to such a direction that the lid plates 7 are opened. This configuration also restricts pivoting of the second engagement protrusion 77*b* to such a direction that the lid plates 7 are closed.

As a result, as shown in FIG. 4 and FIG. 5, the lid plates 7 are retained in a state of being opened at an opening angle θ from a horizontal state where the opening 2*a* of the upper frame 2 is closed. When the opening angle θ of the lid plates 7 is not more than 90°, it becomes difficult to perform packing and unpacking operations. When, on the other hand, the opening angle θ of the lid plates 7 is not less than 135°, due to an own weight of each of the lid plates 7, the first engagement protrusion 77*a* becomes likely to be disengaged from the angle restrictor 20*a*, so that it becomes difficult to retain the lid plates 7 in an opened state. Furthermore, an increased space is required for the packing and unpacking operations.

In order to facilitate storing and taking out an article to be packed, to retain the lid plates 7 stably in the opened state, and to reduce a space required for the packing and unpacking operations to a minimum, the opening angle θ is increased from the horizontal state to preferably 90° to 135° and more preferably 100° to 110°.

Furthermore, when an external force of a given magnitude or higher is applied to the lid plates 7 being retained at the opening angle θ, the angle restrictor 20*a* becomes disengaged from the first engagement protrusion 77*a* or the second engagement protrusion 77*b*, and thus the lid plates 7 are allowed to pivot freely. Accordingly, it is possible to suppress deformation or breakage of the bearings 70*a* to 70*c* of the lid plates 7 and the lid plate support portions 20 of the upper frame 2.

In the present embodiment, the first engagement protrusion 77*a* or the second engagement protrusion 77*b* is provided at a single location on each of the bearings 70*a* to 70*c* in the circumferential direction, and the angle restrictor 20*a* is provided at a single location in the pivotal direction of the bearings 70*a* to 70*c*. Instead of this configuration, a plurality of first engagement protrusions 77*a* or a plurality of second engagement protrusions 77*b* is provided at different positions on each of the bearings 70*a* to 70*c* in the circumferential direction, or the angle restrictor 20*a* is provided at each of plural locations along the pivotal direction of the bearings 70*a* to 70*c*, and thus the lid plates 7 can be retained in a state of being opened at a plurality of opening angles θ.

Furthermore, while in the present embodiment, the first engagement protrusion 77*a* and the second engagement protrusion 77*b* are provided so that the bearings 70*a* to 70*c* each have a single first engagement protrusion 77*a* or a single second engagement protrusion 77*b*, the first engagement protrusion 77*a* and the second engagement protrusion 77*b* may be provided on a common one of the bearings 70*a* to 70*c*. That is, a configuration could be adopted in which the first engagement protrusion 77*a* is formed on at least one of the bearings 70*a* to 70*c*, and the second engagement protrusion 77*b* is formed on at least one of the bearings 70*a* to 70*c* identical to or different from the at least one of the bearings 70*a* to 70*c* on which the first engagement protrusion 77*a* is formed.

Furthermore, the lid plates 7 are retained in a state of being opened upward, and thus an article to be packed (herein, a blister pack) can be guided into the collapsible container 100 along the rear surface of each of the lid plates 7. At this time, the first ribs 74 formed on the rear surface of each of the lid plates 7 are set to have a height (a protruding amount from the each of the lid plates 7) larger than that of the second ribs 75, and thus the article to be packed becomes unlikely to get caught by the second ribs 75 perpendicular to directions for storing and taking out the article to be packed. Moreover, the inclined surface 76 inclined downward toward the opening 2*a* is formed in a neighborhood of the bearings 70*a* to 70*c* of each of the lid plates 7, and thus the article to be packed becomes unlikely to get caught by a lower end of the each of the lid plates 7. Accordingly, the article to be packed can be smoothly stored in or taken out from the collapsible container 100.

Furthermore, the upper frame 2 is colored in white, and thus visibility in a vicinity of the opening 2*a* of the upper frame 2 can be increased. This facilitates storing and taking out the article to be packed even in a dimly lit factory. Furthermore, it becomes possible to clearly print a logo or a QR code on the upper frame 2.

The lower frame 1, the flip-up lateral plates 3, the divided lateral plates 4, and the lid plates 7, on the other hand, are colored in black, exhibiting an increased contrast with the upper frame 2 colored in white, and thus it is facilitated to visually identify the up-down direction (a vertical direction) of the collapsible container 100 in the collapsed state shown in FIG. 2. Moreover, even when a large number of collapsible containers 100 are stacked on each other, the number of the collapsible containers 100 can be easily determined.

While in the present embodiment, the upper frame 2 is colored in white, and the lower frame 1, the flip-up lateral plates 3, the divided lateral plates 4, and the lid plates 7 are colored in black, it is only required that the upper frame 2 be colored in a color higher in lightness than a color of the lower frame 1, the flip-up lateral plates 3, the divided lateral plates 4, and the lid plates 7, and colors that can be adopted include any other colors without being limited to white and black.

Figure 8:
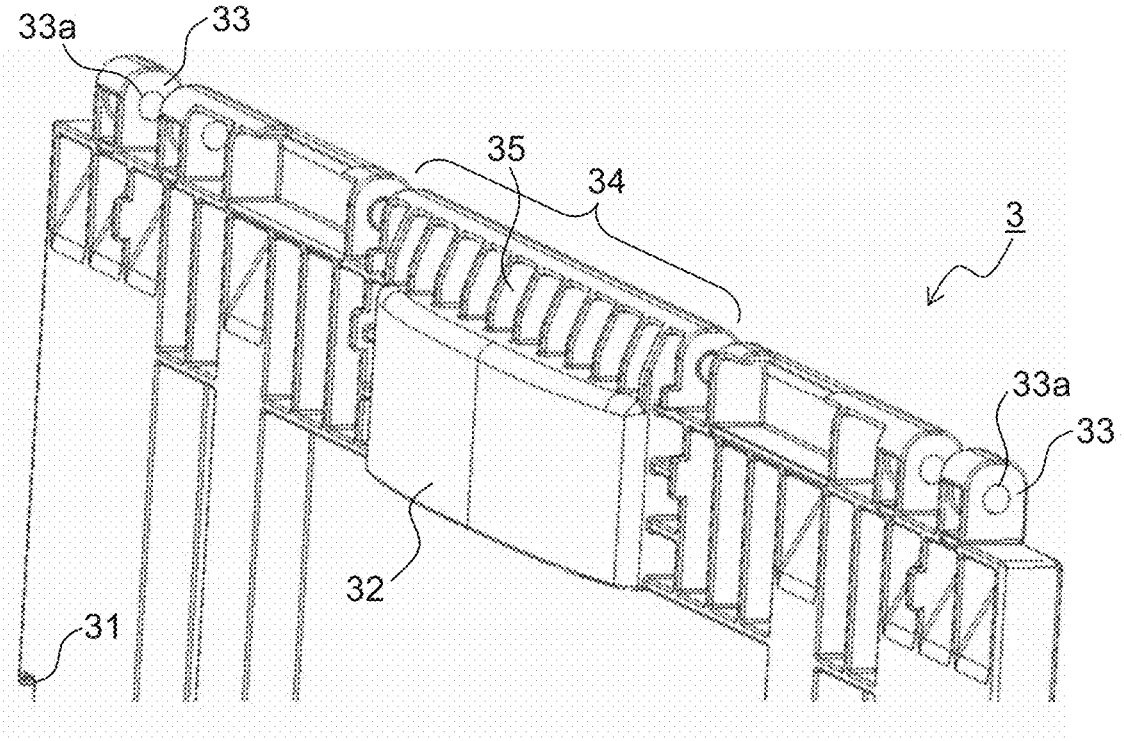
FIG. 8 A perspective view of a neighborhood of an upper end of the flip-up lateral plate 3.

FIG. 8 is a perspective view of a neighborhood of the upper end of each of the flip-up lateral plates 3. Pivotal fulcrums 33 each having a through hole 33*a* are formed at both widthwise ends of the upper end of each of the flip-up lateral plates 3 so as to interpose a gap portion 34 therebetween. Furthermore, a lateral plate support portion (not shown) is formed on the inner side of each of the first lateral surfaces 2*b* of the upper frame 2. A resinous pin (not shown) is inserted through the through hole 33*a* and a bearing hole of the lateral plate support portion, and thus the flip-up lateral plates 3 are supported to the upper frame 2 so as to be pivotable up and down.

A second grip portion 32 is formed at a widthwise center of the upper end of each of the flip-up lateral plates 3. The second grip portion 32 is formed in a shape of an elongated quadrilateral tube whose lower end is open. In carrying the collapsible container 100 in the assembled state (see FIG. 1), a pair of second grip portions 32 formed on the flip-up lateral plates 3 is gripped with fingers inserted from lower ends of the second grip portions 32. Restriction ribs 35 are formed above and adjacently to each of the second grip portions 32. In the gap portion 34 at the upper end of each of the flip-up lateral plates 3, the restriction ribs 35 are formed over an entire widthwise region of a corresponding one of the second grip portions 32 coaxially with the pivotal fulcrums 33.

Figure 9:
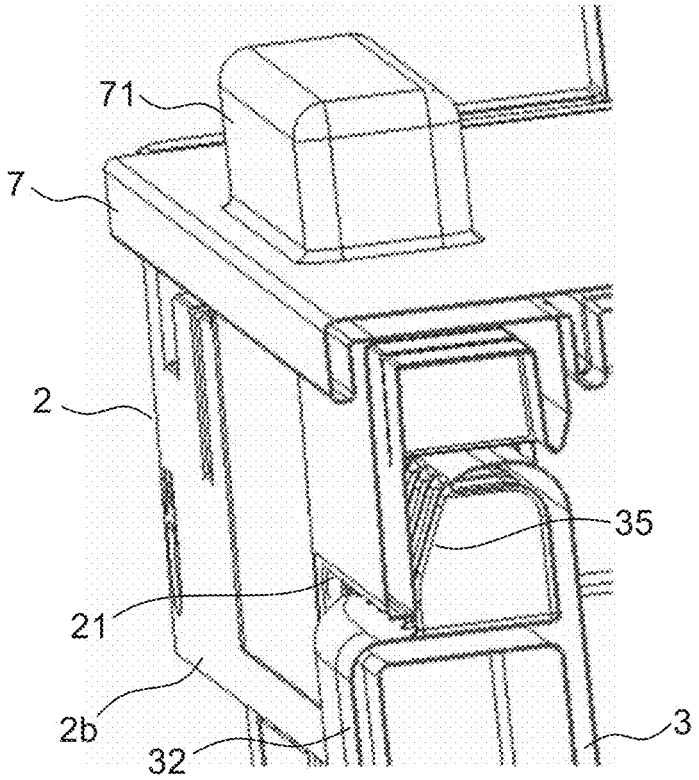
FIG. 9 A sectional perspective view of a vicinity of a joint between an upper frame 2 and the flip-up lateral plate 3, illustrating an upright state of the flip-up lateral plate 3.
Figure 10:
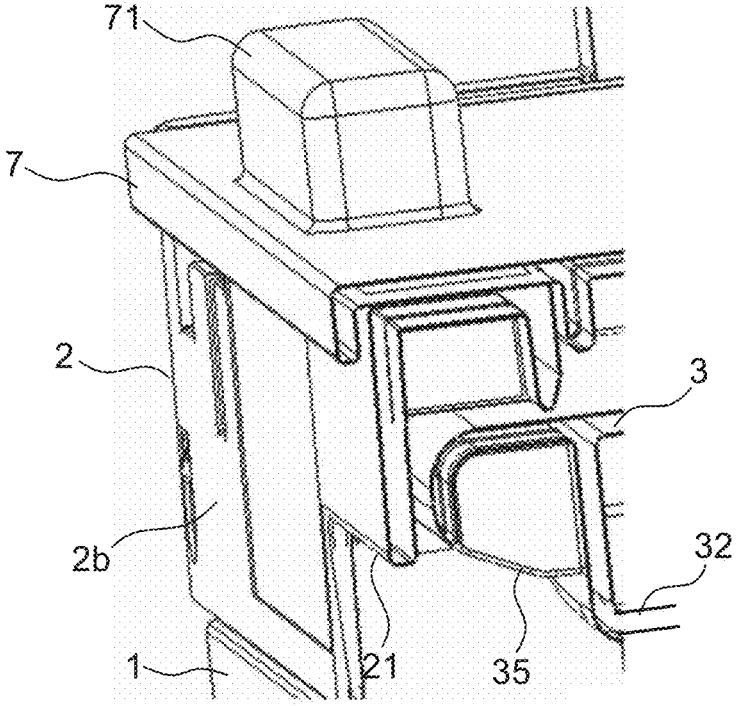
FIG. 10 A sectional perspective view of the vicinity of the joint between the upper frame 2 and the flip-up lateral plate 3, illustrating a laid-down state of the flip-up lateral plate 3.

FIG. 9 and FIG. 10 are sectional perspective views of a vicinity of a joint between the upper frame 2 and each of the flip-up lateral plates 3, illustrating an upright state and a laid-down state of the each of the flip-up lateral plates 3, respectively. In a state where the collapsible container 100 is assembled in box form, the flip-up lateral plates 3 are perpendicularly upright. As shown in FIG. 9, the second grip portions 32 of the flip-up lateral plates 3 are each disposed below and adjacently to the first grip portion 21 having a cutout shape. Furthermore, the restriction ribs 35 are disposed behind the first grip portion 21.

In a state where the collapsible container 100 is collapsed flat, the flip-up lateral plates 3 are laid down horizontally by pivoting 90° from the state shown in FIG. 9. As shown in FIG. 10, the second grip portions 32 of the flip-up lateral plates 3 are each tucked between the lower frame 1 and the upper frame 2. Furthermore, the restriction ribs 35 are disposed to fill a gap between the first grip portion 21 and each of the second grip portions 32.

With the above-described configuration, in gripping the first grip portion 21 of the collapsible container 100 in the collapsed state, the restriction ribs 35 prevent entry of fingers into the gap between the first grip portion 21 and each of the second grip portions 32. Therefore, when the collapsible container 100 is assembled by raising the flip-up lateral plates 3, there is no possibility that the fingers get caught between the first grip portion 21 and the each of the second grip portions 32, and thus it is possible to prevent an operator from suffering from injuries.

Figure 11:
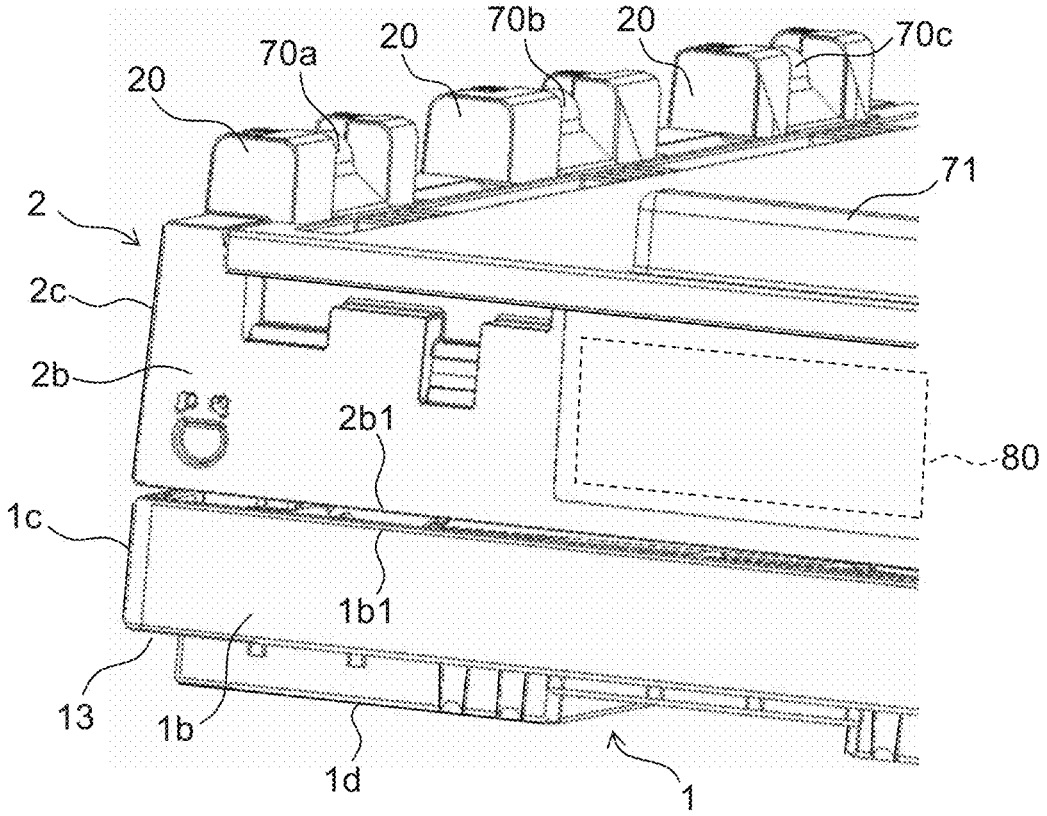
FIG. 11 A partial perspective view of a vicinity of a corner of the collapsible container 100 in the collapsed state.
Figure 12:
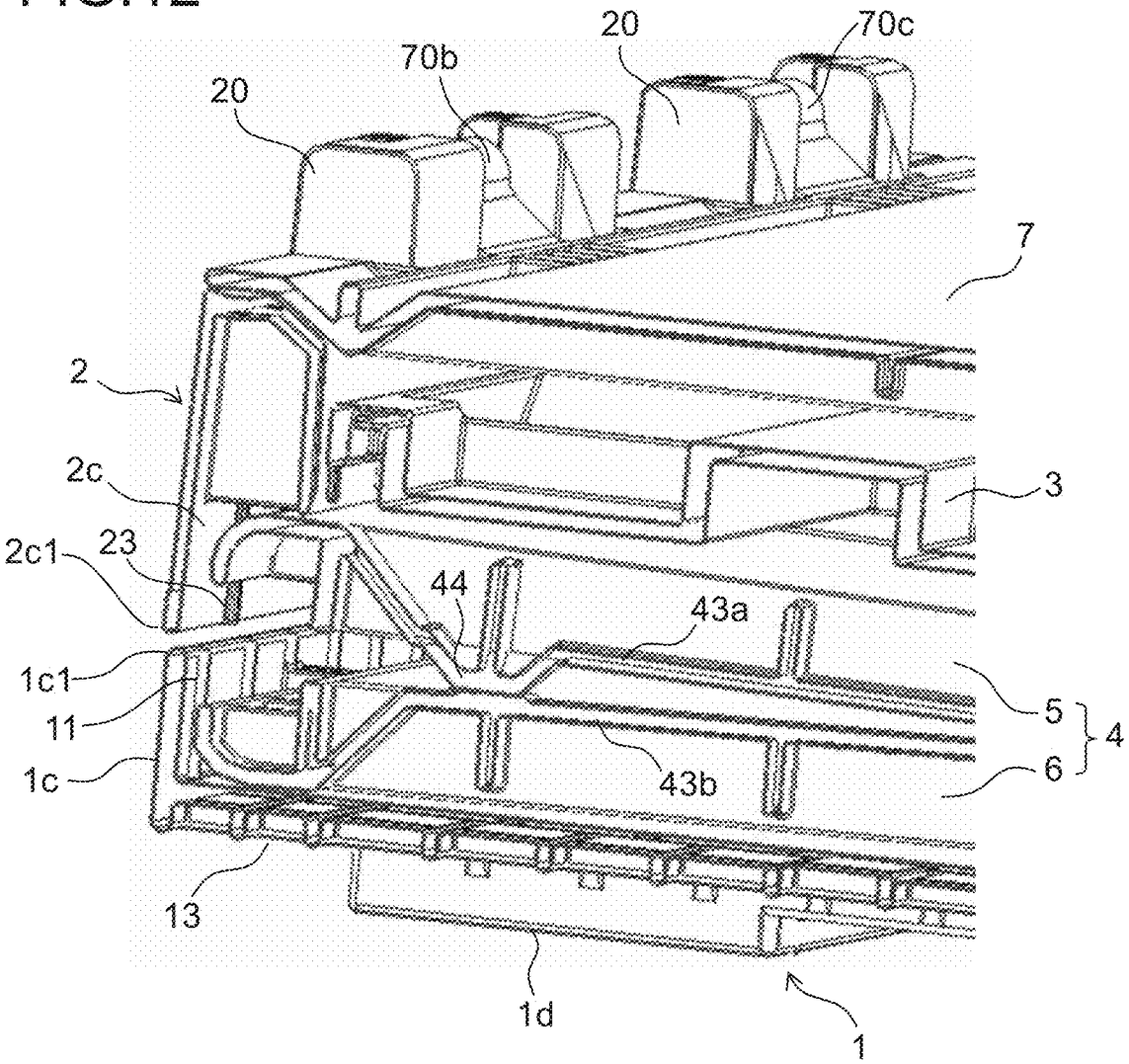
FIG. 12 A partial sectional view of the vicinity of the corner of the collapsible container 100 in the collapsed state as cut along a short side thereof.

FIG. 11 is a partial perspective view of a vicinity of a corner of the collapsible container 100 in the collapsed state. FIG. 12 is a partial sectional view of the vicinity of the corner of the collapsible container 100 in the collapsed state as cut along one of short sides thereof. As shown in FIG. 11, the positioning protrusions 71 formed on the lid plates 7 are disposed along upper ends of the first lateral surfaces 2*b* of the upper frame 2. Furthermore, the lid plate support portions 20 are disposed along an upper end of each of the second lateral surfaces 2*c* of the upper frame 2. When collapsible containers 100 in the assembled or collapsed state are stacked on each other, the lid plate support portions 20 and the positioning protrusions 71 become engaged with a first groove 13 formed along an outer circumferential edge of an installation surface 1*d* of the lower frame 1.

Furthermore, an IC tag 80 is affixed to the inner side of each of the first lateral surfaces 2*b* of the upper frame 2. The IC tag 80 rewritably stores information related to an article to be packed (a component or the like) stored in the collapsible container 100 or information on the collapsible container 100 itself. In the present embodiment, radio frequency identification, which uses a reader/writer module (not shown) to read or rewrite information stored in the IC tag 80, is used to identify the collapsible container 100 and the article to be packed stored in the collapsible container 100.

With the IC tag 80 affixed to the inner side of each of the first lateral surfaces 2*b* of the upper frame 2, it becomes unlikely that rainwater or dust adheres to the IC tag 80 during transportation or safekeeping of the collapsible container 100. Furthermore, the IC tag 80 can be protected from an impact during transportation.

Furthermore, in a case where the article to be packed stored in the collapsible container 100 is a metallic component, the information magnetically stored in the IC tag 80 may be affected by the metallic component, thus failing to be read. The IC tag 80 is attached to the upper frame 2 and thus can be kept at a given distance from the metallic component stored in the collapsible container 100. Thus, the IC tag 80 becomes unlikely to be affected by the metallic component, so that such a failure to read the IC tag 80 can be suppressed.

As shown in FIG. 12, in the collapsed state of the collapsible container 100, the lower lateral plate 6 and the upper lateral plate 5 constituting each of the divided lateral plates 4 are collapsed, each of the flip-up lateral plates 3 laid down horizontally is overlaid on the upper lateral plate 5, and these plates are tucked between the lower frame 1 and the upper frame 2 with the lid plates 7 mounted thereto.

Furthermore, in a state where the lower lateral plate 6 and the upper lateral plate 5 are collapsed, the upper reinforcement rib 43*a* formed on the upper lateral plate 5 is opposed to an upper part of the lower reinforcement rib 43*b* formed on the lower lateral plate 6. Herein, on the upper reinforcement rib 43*a* formed on the upper lateral plate 5, there is formed a convexity 44 that is to contact the lower reinforcement rib 43*b* formed on the lower lateral plate 6. The convexity 44 protrudes from an upper surface of the upper reinforcement rib 43*a* (a surface facing an outside of the collapsible container 100 in the assembled state). The convexity 44 is formed at an end of the upper reinforcement rib 43*a* distant from the hinge 8 (on an upper side of the upper lateral plate 5) so as to contact an end of the lower reinforcement rib 43*b* distant from the hinge 8 (on a lower side of the lower lateral plate 6).

The convexity 44 formed on the upper reinforcement rib 43*a* contacts the lower reinforcement rib 43*b*, and thus there can be achieved a balance of a pressing force acting on the lower lateral plate 6 and the upper lateral plate 5 in the collapsed state. It is, therefore, possible to reduce a load applied to the hinge 8, thus effectively suppressing deformation or breakage of the upper lateral plate 5, the lower lateral plate 6, and the hinge 8. Furthermore, the convexity 44 is formed at the end of the upper reinforcement rib 43*a* distant from the hinge 8, and thus a distance is increased between the convexity 44 and the hinge 8, both receiving the pressing force. Accordingly, it is possible to more effectively reduce a load applied to the hinge 8.

While in the present embodiment, the convexity 44 is formed at the end of the upper reinforcement rib 43*a* distant from the hinge 8 (on the upper side of the upper lateral plate 5), the convexity 44 may be formed at the end of the lower reinforcement rib 43*b* distant from the hinge 8 (on the lower side of the lower lateral plate 6).

Figure 13:
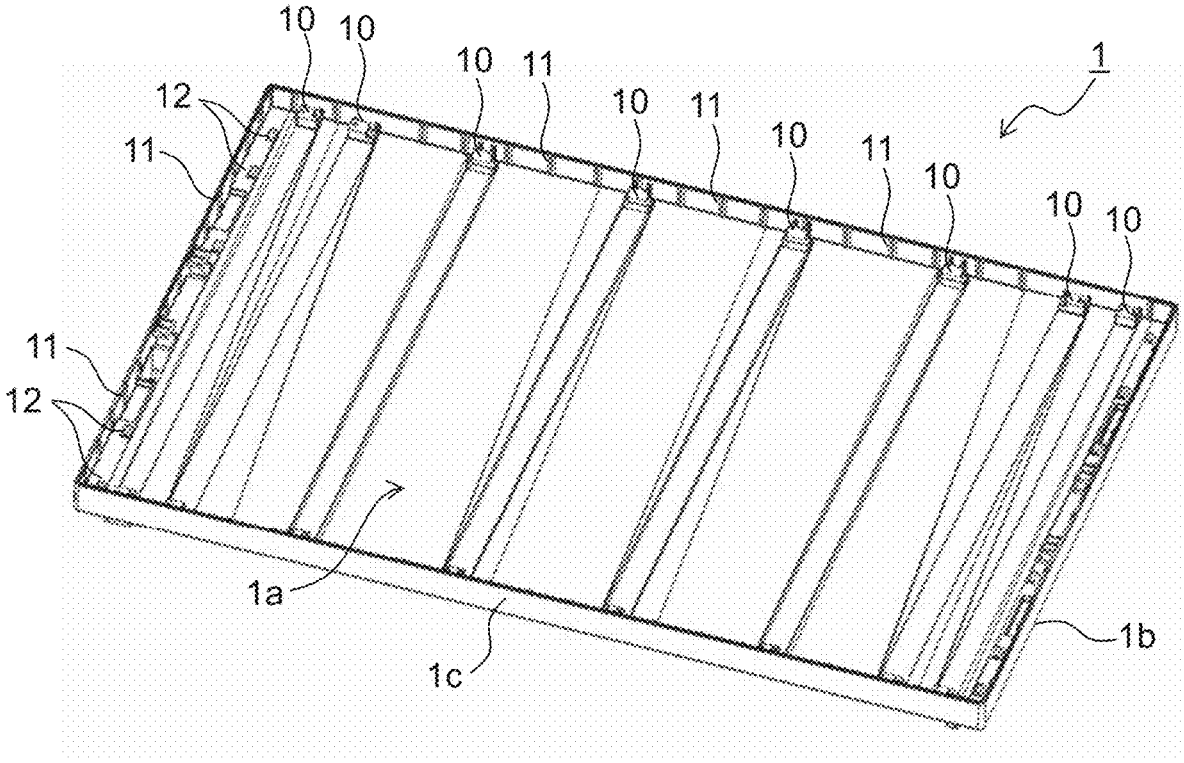
FIG. 13 A perspective view of a lower frame 1 as viewed from above.
Figure 14:
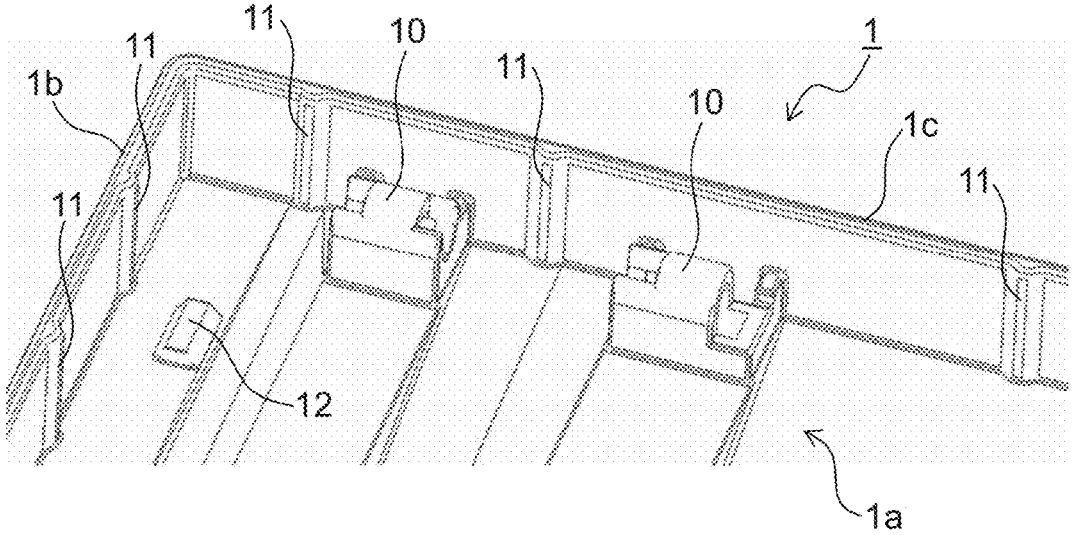
FIG. 14 An enlarged perspective view of a vicinity of a corner of the lower frame 1.

FIG. 13 is a perspective view of the lower frame 1 as viewed from above (an inner surface side thereof). FIG. 14 is an enlarged perspective view of a vicinity of a corner (an upper left corner in FIG. 13) of the lower frame 1. On inner lateral surfaces of the first upright walls 1*b* and the second upright walls 1*c* of the lower frame 1, a plurality of second reinforcement ribs 11 is formed to extend in a perpendicular direction. Furthermore, also on inner lateral surfaces of the first lateral surfaces 2*b* and the second lateral surfaces 2*c* of the upper frame 2, third reinforcement ribs 23 (see FIG. 12) are formed to extend in the perpendicular direction.

In the collapsed state of the collapsible container 100, as shown in FIG. 11, an upper end 1*b*1 of each of the first upright walls 1*b* of the lower frame 1 is opposed to a lower end 2*b*1 of a corresponding one of the first lateral surfaces 2*b*. Furthermore, as shown in FIG. 12, an upper end 1*c*1 of each of the second upright walls 1*c* of the lower frame 1 is opposed to a lower end 2*c*1 of a corresponding one of the second lateral surfaces 2*c*.

There is, therefore, a possibility that, under a load (a pressing force) in the up-down direction as in a case, for example, where a large number of collapsible containers 100 in the collapsed state are stacked on each other, the first upright walls 1*b* are brought into pressure contact with the first lateral surfaces 2*b*, and the second upright walls 1*c* are brought into pressure contact with the second lateral surfaces 2*c*, so that deformation or breakage thereof occurs. By forming the second reinforcement ribs 11 on the first upright walls 1*b* and the second upright walls 1*c* and forming the third reinforcement ribs 23 on the first lateral surfaces 2*b* and the second lateral surfaces 2*c*, it is possible to effectively suppress deformation or breakage of the lower frame 1 and the upper frame 2 under the load in the up-down direction.

Figure 15:
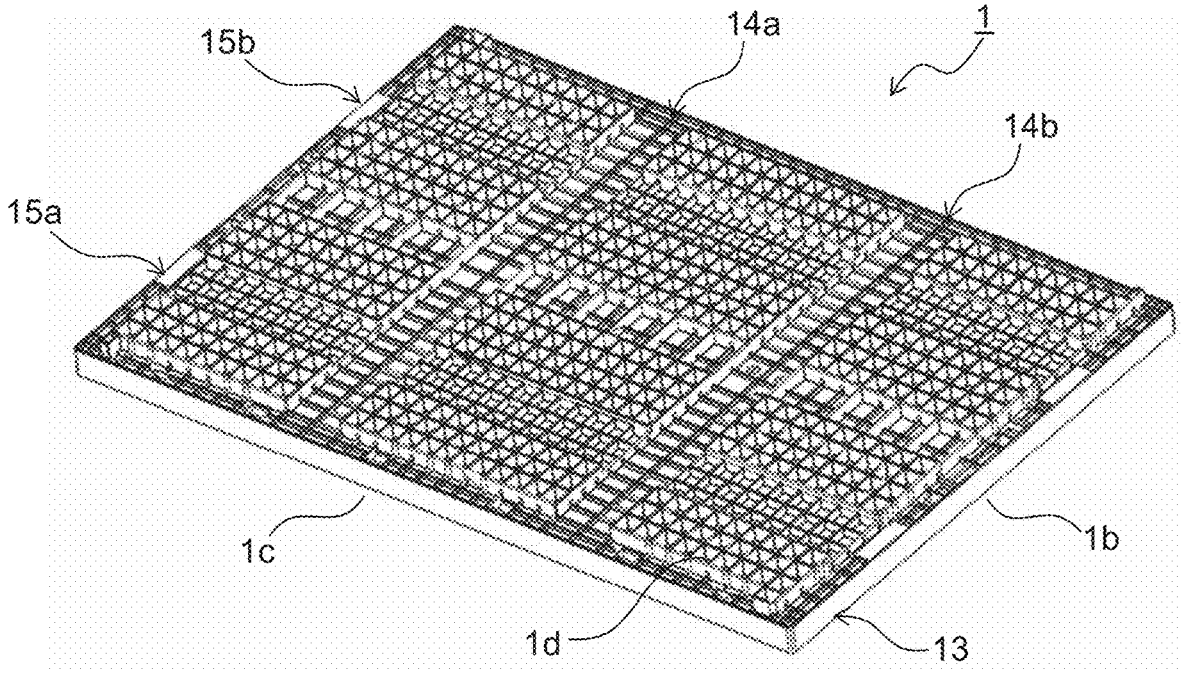
FIG. 15 A perspective view of the lower frame 1 as viewed from below.
Figure 16:
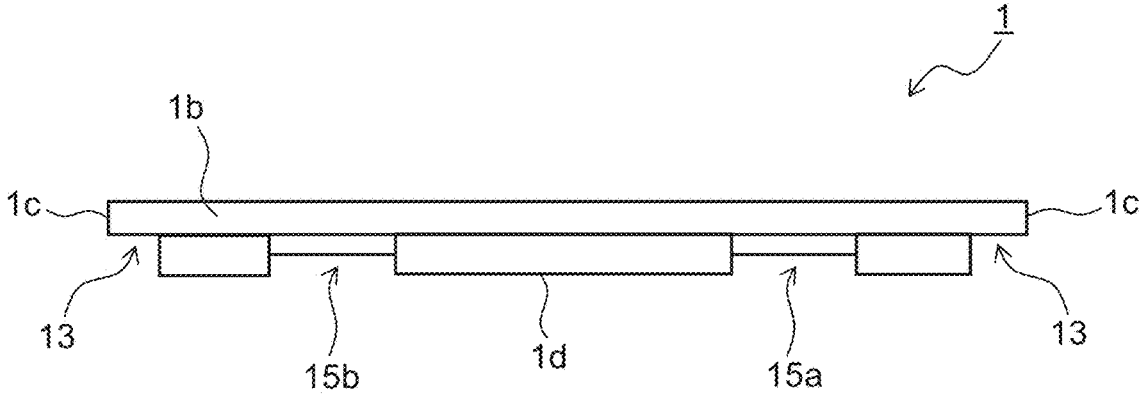
FIG. 16 A lateral view of the lower frame 1 as viewed from near a first upright wall 1*b;*

FIG. 15 is a perspective view of the lower frame 1 as viewed from below (near the installation surface 1*d*). FIG. 16 is a lateral view of the lower frame 1 as viewed from near one of the first upright walls 1*b*. The installation surface 1*d* of the lower frame 1 has the first groove 13, second grooves 14*a* and 14*b*, and third grooves 15*a* and 15*b* formed therein. The installation surface 1*d* has a ribbed structure in lattice form therein.

Figure 17:
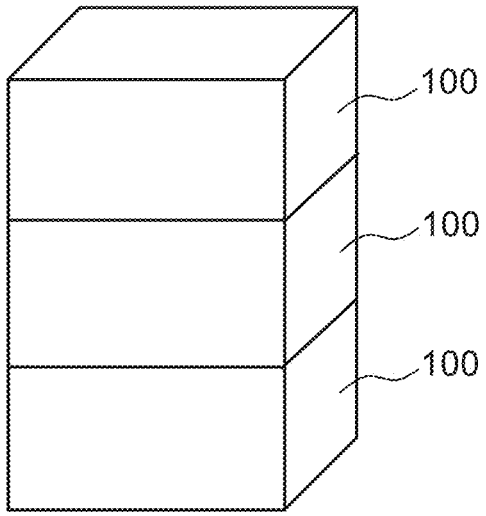
FIG. 17 A perspective view showing a state where collapsible containers 100 are stacked up.

The first groove 13 is formed in loop form along an outer circumferential edge of the lower frame 1. When collapsible containers 100 are stacked up as shown in FIG. 17, the lid plate support portions 20 and the positioning protrusions 71 of a lower one of each pair of vertically adjacent collapsible containers 100 become engaged with the first groove 13 of an upper one of the each pair of vertically adjacent collapsible containers 100 overlaid thereon. The lid plate support portions 20 protrude to a height equal to a protruding height of the positioning protrusions 71 and thus also have a positioning function similar to that of the positioning protrusions 71. Thus, when collapsible containers 100 are stacked up, it is possible to prevent an overlaid upper one(s) of the collapsible containers 100 from sliding sideways to cause misalignment or load disruption.

The second grooves 14*a* and 14*b* are formed parallel to the first upright walls 1*b*. A distance between the second groove 14*a* and one of the first upright walls 1*b* opposed thereto via the second groove 14*b* and a distance between the second groove 14*b* and the other of the first upright walls 1*b* opposed thereto via the second groove 14*a* are each equal to a distance between the second lateral surfaces 2*c* of the upper frame 2. The first groove 13 and the second grooves 14*a* and 14*b* have an equal level difference from the installation surface 1*d* (depth from the installation surface 1*d*).

Figure 18:
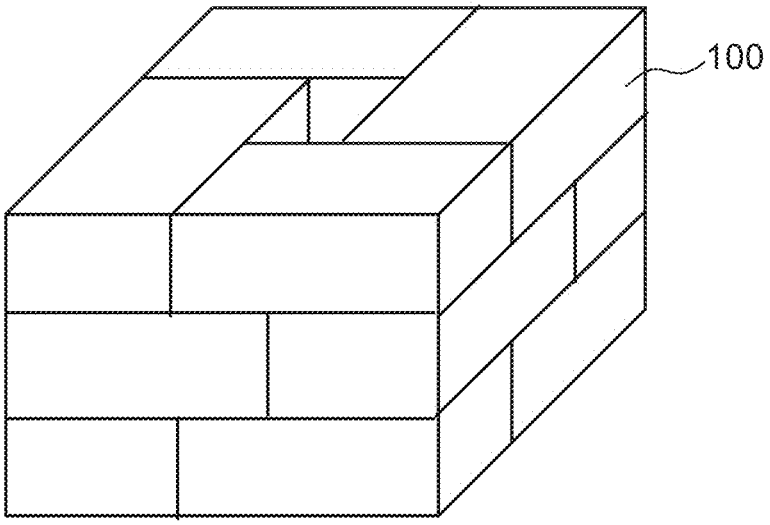
FIG. 18 A perspective view showing a state where collapsible containers 100 are stacked in a pinwheel configuration.

Thus, when four collapsible containers 100 are joined together in square form to form a tier of collapsible containers 100 and such tiers of collapsible containers 100 are alternately stacked (stacked in a pinwheel configuration) as shown in FIG. 18, the lid plate support portions 20 of a lower one of each pair of vertically adjacent collapsible containers 100 become engaged with a part of the first groove 13 extending along each of the first upright walls 1*b* and either one of the second grooves 14*a* and 14*b*. Furthermore, the positioning protrusions 71 become engaged with a part of the first groove 13 extending along each of the second upright walls 1*c*. Thus, when collapsible containers 100 are stacked in a pinwheel configuration, it is possible to prevent an overlaid upper one(s) of the collapsible containers 100 from sliding sideways to cause misalignment or load disruption.

Figure 19:
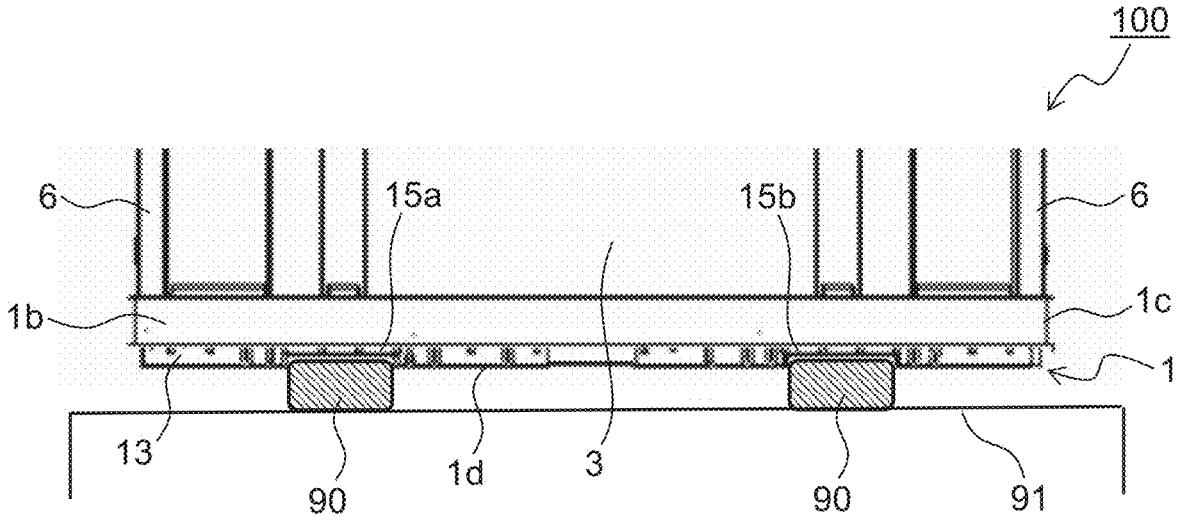
FIG. 19 A lateral view of a lower end of the collapsible container 100 placed on support rails 90 as viewed from near the flip-up lateral plate 3.

The third grooves 15*a* and 15*b* are formed parallel to the second upright walls 1*c*. As shown in FIG. 19, support rails 90 for moving the collapsible container 100 are fitted into the third grooves 15*a* and 15*b*. The support rails 90 are provided on a support surface 91 that is an upper surface of an AGV (automatic guided vehicle) on which the collapsible container 100 is loaded. When automatically moved from the AGV onto a work line, the collapsible container 100 is guided along the support rails 90.

The collapsible container 100 is moved along the support rails 90, with the third grooves 15*a* and 15*b* fitted over the support rails 90, and thus when moved from the AGV onto the work line, the collapsible container 100 can be prevented from being inclined with respect to the support surface 91 or falling on the support surface 91. Accordingly, it is possible to smoothly and efficiently perform packing and unpacking operations with respect to the collapsible container 100 in a factory.

The third grooves 15*a* and 15*b* have a level difference from the installation surface 1*d* (a depth from the installation surface 1*d*) smaller than that of the first groove 13 and the second grooves 14*a* and 14*b*. In a case where the level difference of the third grooves 15*a* and 15*b* is equal to that of the first groove 13 and the second grooves 14*a* and 14*b*, an area of the installation surface 1*d* is decreased by areas occupied by the third grooves 15*a* and 15*b*, and thus the ribbed structure forming the installation surface 1*d* is also decreased. As a result, there is a possibility that strength of the bottom plate 1 is decreased to cause warpage or deformation thereof. To avoid this, the level difference of the third grooves 15*a* and 15*b* is set to be smaller than that of the first groove 13 and the second grooves 14*a* and 14*b* so that a part of the ribbed structure remains on a bottom surface of each of the third grooves 15*a* and 15*b*. Thus, it is possible to obtain strength of the bottom plate 1 sufficient to effectively suppress warpage or deformation thereof, while maintaining fittability between the bottom plate 1*a* and the support rails 90.

Other than the above, the present invention is not limited to the foregoing embodiment and can be variously modified without departing from the spirit of the present invention. For example, respective shapes, positions, dimensions, and so on of the lower frame 1, the upper frame 2, the flip-up lateral plates 3, the divided lateral plates 4, the lid plates 7, the hinge 8, and so on can be arbitrarily changed.

INDUSTRIAL APPLICABILITY

The present invention is usable in a collapsible container that can be collapsed. Through the use of the present invention, it is possible to provide a collapsible container capable of reducing a load applied to a hinge connecting an upper lateral plate to a lower lateral plate in a collapsed state.

The invention claimed is:

1. A collapsible container, comprising:

a lower frame including a rectangular bottom plate;

an upper frame that has a frame shape identical to that of an outer rim of the lower frame and includes a pair of first lateral surfaces opposed to each other and a pair of second lateral surfaces each connecting an end of one of the pair of first lateral surfaces to an end of another of the pair of first lateral surfaces;

a pair of flip-up lateral plates, each of which is swingably supported at an upper end to the upper frame and is configured to swing between an upright state of being perpendicularly upright with respect to the bottom plate along a corresponding one of the pair of first lateral surfaces and a laid-down state of being laid down to be overlaid on the bottom plate;

a pair of divided lateral plates, each of which includes:

an upper lateral plate swingably supported to a corresponding one of the pair of second lateral surfaces;

a lower lateral plate swingably supported to the bottom plate; and a hinge pivotably connecting a lower end of the upper lateral plate to an upper end of the lower lateral plate, the pair of divided lateral plates being configured to shift between a spread state where the upper lateral plate and the lower lateral plate are spread to be substantially flush with each other and a bent state where the upper lateral plate and the lower lateral plate are bent inwardly; and a pair of lid plates, each of which is pivotably supported to an upper part of a corresponding one of the pair of second lateral surfaces and thus enables opening and closing of an opening of the upper frame, the collapsible container being collapsible to flat form when the pair of flip-up lateral plates is brought to the laid-down state and the pair of divided lateral plates is brought to the bent state, wherein on outer lateral surfaces of the upper lateral plate and the lower lateral plate, a plurality of first reinforcement ribs is continuously formed to extend linearly in an up-down direction from an upper end to a lower end of each of the pair of divided lateral plates astride the hinge, the lower frame includes:

a pair of first upright walls that is perpendicularly upright along two opposed sides of the bottom plate; and a pair of second upright walls that is perpendicularly upright along other two sides of the bottom plate, each of the plurality of first reinforcement ribs includes:

an upper reinforcement rib formed on the upper lateral plate; and a lower reinforcement rib formed on the lower lateral plate, and a convexity is formed on one of the upper reinforcement rib and the lower reinforcement rib, when the pair of divided lateral plates is in the bent state, the upper reinforcement rib is opposed to an upper part of the lower reinforcement rib, and the convexity contacts another of the upper reinforcement rib and the lower reinforcement rib, in a state where the collapsible container is collapsed to flat form, upper ends of the pair of first upright walls are opposed with a prescribed gap to lower ends of the pair of first lateral surfaces, and upper ends of the pair of second upright walls are opposed with a prescribed gap to lower ends of the pair of second lateral surfaces, an installation surface provided on a lower surface of the bottom plate has a plurality of grooves that is formed therein parallel to long sides of the bottom plate so as to be continuous over an entire region of the bottom plate between short sides thereof and into which support rails are fitted, the support rails being provided on a support surface for placing the collapsible container thereon, and the collapsible container moves along the support rails, with the plurality of grooves fitted over the support rails.

2. The collapsible container according to claim 1, wherein the convexity is formed at an end of the upper reinforcement rib or the lower reinforcement rib distant from the hinge.

3. The collapsible container according to claim 1, wherein on inner sides of the pair of first upright walls and the pair of second upright walls, a plurality of second reinforcement ribs is formed to extend in the up-down direction.

4. The collapsible container according to claim 3, wherein on inner sides of the pair of first lateral surfaces and the pair of second lateral surfaces, a plurality of third reinforcement ribs is formed to extend in the up-down direction.

* * * * *